US008695677B2

(12) United States Patent
Kraeutler

(10) Patent No.: US 8,695,677 B2
(45) Date of Patent: Apr. 15, 2014

(54) DOUBLE SCREEN RAPID DOOR

(75) Inventor: Bernard Kraeutler, La Villette (FR)

(73) Assignee: Nergeco (FR)

( * ) Notice: Subject to any disclaimer, the term of this patent is extended or adjusted under 35 U.S.C. 154(b) by 0 days.

(21) Appl. No.: 10/576,657

(22) PCT Filed: Oct. 15, 2004

(86) PCT No.: PCT/FR2004/002638

§ 371 (c)(1),
(2), (4) Date: Oct. 19, 2006

(87) PCT Pub. No.: WO2005/038185

PCT Pub. Date: Apr. 28, 2005

(65) Prior Publication Data

US 2007/0193698 A1 Aug. 23, 2007

(30) Foreign Application Priority Data

Oct. 17, 2003 (FR) ..... 03 12169

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***A47H 1/00*** | (2006.01) |
| ***E06B 9/17*** | (2006.01) |

(52) U.S. Cl.
USPC ..... 160/84.06; 160/266

(58) Field of Classification Search
USPC ..... 160/113, 121.1, 123, 126, 193, 85, 86, 160/118, 133, 201, 264, 266, 84.01
See application file for complete search history.

(56) References Cited

U.S. PATENT DOCUMENTS 3,750,740 A * 8/1973 Newman ..... 160/354
4,625,786 A * 12/1986 Carter et al. ..... 160/84.06

(Continued)

FOREIGN PATENT DOCUMENTS

FR 2 769 944 4/1999
FR 2769944 * 4/1999

(Continued)

OTHER PUBLICATIONS jamb. Dictionary.com. The American Heritage® Dictionary of the English Language, Fourth Edition. Houghton Mifflin Company, 2004. http://dictionary.reference.com/browse/jamb (accessed: Feb. 9, 2009). (definition copied into action).*

(Continued)

*Primary Examiner* — David Purol
*Assistant Examiner* — Jeremy Ramsey
(74) *Attorney, Agent, or Firm* — Cantor Colburn LLP

(57) ABSTRACT

The inventive door comprises two lateral posts (2), a transversal caisson (3) connecting the top ends of the posts and a curtain (10) movable between the closing position thereof, wherein said curtain closes a void formed by posts (2) and caisson (3) and the opening position wherein said curtain is folded up under the caisson (3). According to the invention, said the curtain (10) consisting of two parallel screens (11*a*, 11*b*) defining the boundaries of an air cushion and suspended to the top area of the posts. Said curtain (10) comprises at least one lifting strap (20) connecting the lower part of the curtain (10) to a shaft (21) mounted on the caisson (3) and at least one transversal stiffening means built up on each screen (11*a*, 11*b*), the lateral edges of each screen (11*a*, 11*b*) are applied to the posts in such a way that a lateral surface tight contact is formed.

13 Claims, 2 Drawing Sheets

(56) References Cited

U.S. PATENT DOCUMENTS

| | | | | | |
|---|---|---|---|---|---|
| 4,712,598 | A | * | 12/1987 | Bonacci et al. | 160/84.06 |
| 5,141,043 | A | | 8/1992 | Kraeutler | |
| 5,207,256 | A | * | 5/1993 | Kraeutler | 160/84.02 |
| 6,119,758 | A | * | 9/2000 | Coenraets | 160/273.1 |
| 6,672,360 | B1 | * | 1/2004 | Kraeutler | 160/84.06 |
| 2005/0211391 | A1 | * | 9/2005 | Varley et al. | 160/67 |

FOREIGN PATENT DOCUMENTS

| | | | |
|---|---|---|---|
| GB | 965 141 | | 7/1964 |
| JP | 2002142967 | * | 5/2001 |

OTHER PUBLICATIONS

International Search Report; PCT/FR2004/002638; Apr. 6, 2005.

* cited by examiner

DOUBLE SCREEN RAPID DOOR

FIELD OF THE INVENTION

The present invention relates to a vertically opening door having a flexible curtain able to occupy a closed position or an open position by being folded up at a desired height having a curtain comprising two flexible screens defining an air cushion providing heat or sound insulation.

DESCRIPTION OF RELATED ART

Since these doors provide greater heat and sound insulation than single-screen doors, they are particularly suitable as closures for external apertures of buildings as for example for defining an area exposed to wind, weather and large temperature differences. These doors can also be used to define two areas where one of the areas has high sound levels.

The structure of these doors can be made up of horizontal bars held together by cables or straps. Horizontal strips of flexible fabric, generally PVC, are attached to these bars to form on each side of the bars two screens defining an air cushion. The strips are usually attached by means of bolts on each side of the structure defined in this way.

Assembling these doors is therefore slow, meticulous work. It requires highly skilled staff and a great deal of time.

Moreover, there is a serious drawback with this type of door in that the seal between the screens and the vertical jambs of the door is very imperfect, and it is found that the strips of fabric have a tendency to form a crease and to gape open. In other words, since the distance between the horizontal bars is fixed by cables or belts, the strips of fabric can, particularly depending on temperature conditions, relax and gape apart, and then no longer hug the door jamb.

This gaping obviously defeats the purpose of the insulation which the door is supposed to create.

There are also doors with two parallel screens in which the horizontal bars comprise grooves of trapezoidal section or teardrop section in which the horizontal edges of the strips of fabric are engaged.

Doors of this type also have drawbacks because there is an interruption in the screen at the ends of the horizontal bars where there is no contact with the jambs.

Besides this, it can be quite difficult to insert the strips of fabric into the teardrop-shaped grooves, especially in the case of doors of great width.

Again, document FR-A-2 769 944 discloses a door in which the means for pulling the screen are isolated from the outside. Although this document provides sealing for the pulling means, it says nothing at all about lateral sealing between a screen and the jambs of a door.

BRIEF SUMMARY OF THE INVENTION

The invention provides a door comprising a double screen that defines an air cushion but that is easy to install and creates a highly effective seal.

As in the prior art, this door comprises two jambs, a transverse box joining the top ends of the two jambs, and a curtain moveable between a closed position in which it closes the opening formed by the jambs and box and an open position in which it is folded up under the box.

According to the invention, the door comprises a curtain consisting of two parallel screens that define an air cushion and that are suspended from the top region of the jambs, the curtain comprising:

at least one lifting strap connecting the bottom part of the curtain to a shaft mounted in or in the region of the box, and at least one transverse stiffening means fitted to each of the screens, the side edges of each screen lying against the jambs to form an airtight lateral surface contact.

The fundamental idea on which the invention is based is, in a double screen curtain, to place stiffening bars in sheaths formed in each screen in such a way that the inside face of each of the two outside faces of the double screen is flat and is always taut when in the closed position so that, where it meets a track formed in the vertical jambs, a surface contact is formed that completely insulates the air cushion formed between the two screens. In addition, the curtain can be manufactured entirely in the factory and then simply erected on the final site.

Advantageously, the sheaths of each of the screens are opposite each other.

To increase the modulus of section of the curtain and so improve its behavior particularly when the door is exposed to the wind, at least one pair of two stiffening bars, engaged in two mutually opposite sheaths, has at least one spacer connecting the said bars.

Advantageously, the spacer has an opening for the lifting strap to pass through.

One advantageous possibility is that at least two pairs of stiffening bars with spacers alternate with at least one pair of stiffening bars without spacers, in such a way that, when the curtain is in the raised position, alternate folds form symmetrically about the plane in which the door opens.

To seal the bottom edge of the door, the bottom part of the curtain formed by the connecting fold between the two screens contains a flexible component consisting of a flexible sleeve containing a flexible material.

One possibility is that the flexible component consists of a flexible bar comprising a spring in a foam sleeve.

In one embodiment, the ends of each stiffening bar are fitted with guide components for guiding them relative to each of the jambs.

The stiffening bars preferably have the flexibility to absorb an abnormal exiting impact, to come free or to come away from the tracks without suffering permanent deformation so that the curtain is not damaged by a collision with for example a vehicle.

Advantageously, the flexible bar held in the connecting fold of the two screens, the lower pair of bars with spacers and the succeeding pair of bars without spacers are at distances such that, when the curtain is in the raised position, the flexible bar projects beyond the folds formed by each folded screen in such a way that in the event of a collision with the curtain, the contact takes place with the flexible bar rather than with a stiffening bar.

One possibility is that each screen is a multilayer complex.

In one advantageous embodiment, each screen has, at the same height, at least one transverse panel made of a transparent material.

In accordance with an alternative, between two pairs of bars with spacers, each screen is provided with at least one shape-memory folding means capable of forming an outward fold in the curtain when the curtain is in the folded position.

As regards the curtain, one possibility is for it to be made from a single component of flexible material and then folded on itself to form two screens.

Another possibility is that each screen comprises at least two transverse panels of flexible material connected by a sheath.

Advantageously, the ends of each stiffening bar of a pair of bars without spacers are fitted with a guide endpiece which has a flat part oriented in the plane of the screen in which the bar is located.

One possibility is that a spacer connects the ends of a pair of bars and carries a roller engageable between two tracks which are formed in each of the vertical jambs.

In addition, the invention allows filler endpieces to be engaged on the end of each of the bars to prevent the formation of folds.

In one possible embodiment of the stiffening means of the flexible screens, a cable is engaged in at least one sheath whose ends are guided relative to the vertical jambs.

BRIEF DESCRIPTION OF THE DRAWINGS

To enable the invention to be understood clearly, it will be described with reference to the accompanying drawing which shows a non-restrictive example of an embodiment of a door according to the invention.

DETAILED DESCRIPTION OF THE INVENTION

Figure 1:
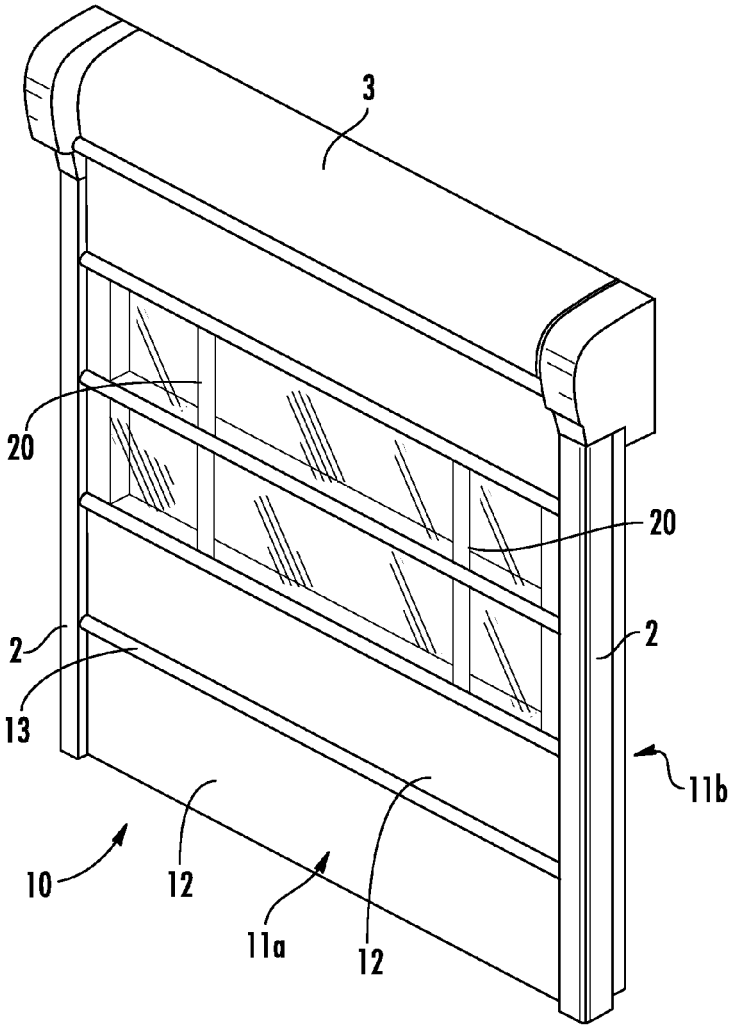
FIG. 1 is a perspective view of a double screen door according to the invention.

Referring to the drawing, the door can be seen to comprise two jambs 2 joined at their top ends by a box 3. The box 3 can also be termed the crossmember. To close the opening defined by the jambs and the box, the door comprises a flexible curtain 10 that can be folded up into the top part of the door, that is to say underneath the box 3, to allow the passage of people or vehicles.

As FIG. 1 shows, the curtain 10 consists of two parallel screens 11*a*, 11*b*. These two screens 11*a*, 11*b* define an air cushion which gives the door very effective sound and heat insulation.

Figure 2:
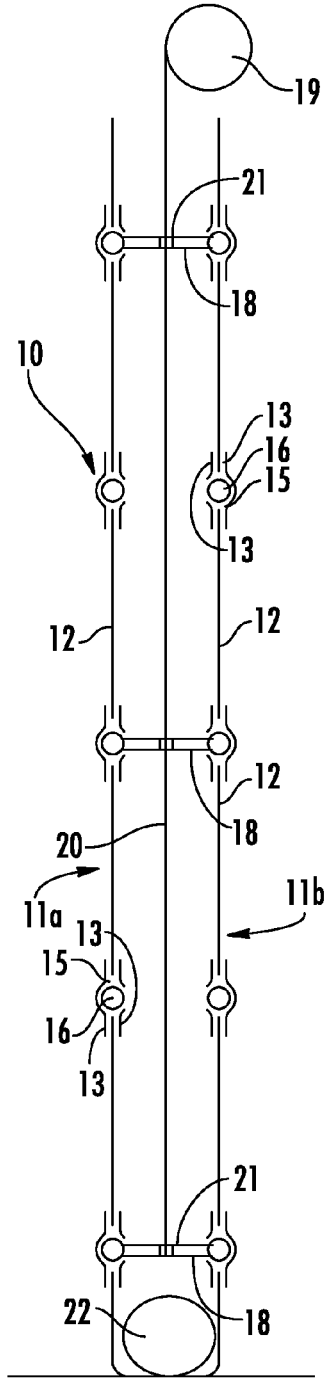
FIG. 2 is a section through the curtain of the door.

In the example shown in the drawing, each screen 11*a*, 11*b* consists of panels 12 of flexible material: this may be transparent or opaque PVC. As can be seen in FIG. 2, between two consecutive panels 12, two superimposed strips 13 are welded to each of the panels 12 and thus form a sheath 15. In the example illustrated, each of the screens 11*a*, 11*b* has four equidistant sheaths 15, although the number of sheaths 15 obviously depends on the height of the door.

A stiffening bar 16 is engaged into each sheath 15. This stiffening bar 16 is made of a flexible material which may be a pultruded composite. The sheaths 15 of each screen 11 are so arranged that the stiffening bars 16 are opposite each other at the same height to form a pair of stiffening bars.

Notice also that the stiffening bars 16 of certain pairs are connected by two spacers 18. The assembly formed by these two bars 16 with spacers thus has a high modulus of section.

Pairs of bars 16 with spacers alternate with pairs without spacers.

The curtain is raised by two lifting straps 20. One end of each strap is connected to a shaft 19 mounted in the box 3 of the door, and the other to the lowest pair of stiffening bars. It should be pointed out that spacers 18 connecting stiffening bars situated above the lowest pair with spacers are provided with an opening 21 for a lifting strap 20 to pass through.

The curtain 10 is also provided, at the connecting fold between the two screens 11*a*, 11*b*, with a flexible bar 22 which may take the form of a spring in a sleeve of absorbent foam.

Figure 3:
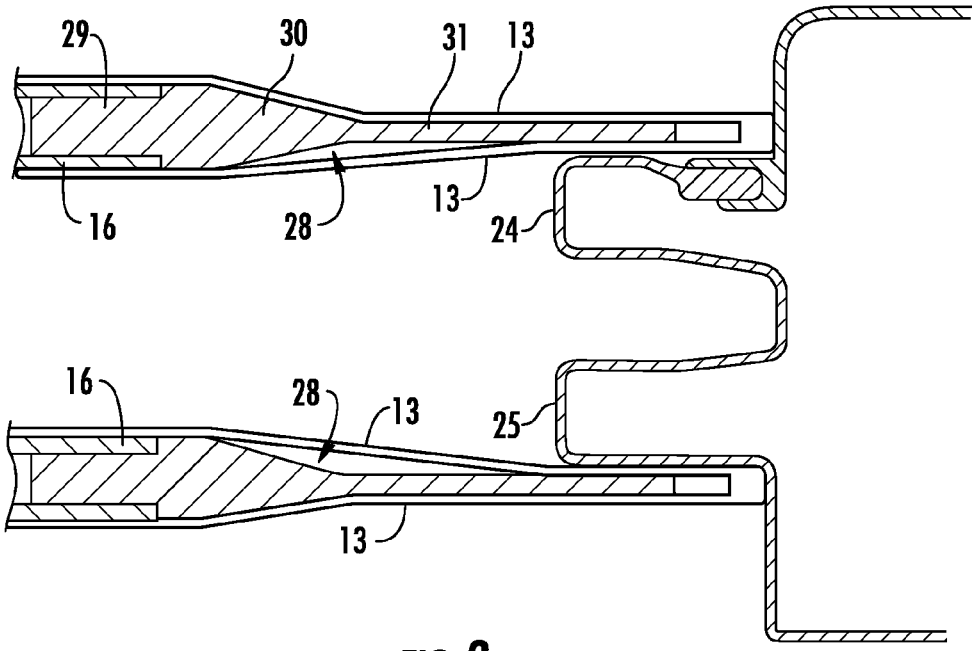
FIGS. 3 and 4 is a sectional view of the door through one of its jambs.
Figure 4:
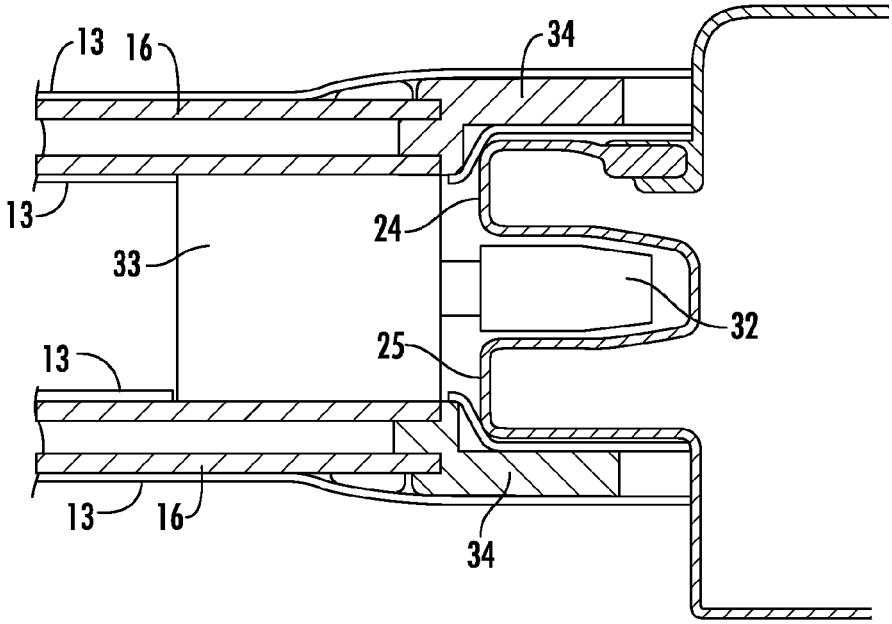

FIGS. 3 and 4 illustrate the manner in which the ends of the stiffening bars can be guided in one embodiment of the invention relative to the jambs 2.

First of all, it will be seen that the jambs 2 themselves incorporate two parallel tracks 24 and 25.

Referring initially to FIG. 3, it will be seen that the guide endpieces 28 are inserted into each of the stiffening bars 16. These endpieces 28 have a cylindrical part 29 whose diameter matches the inside diameter of the stiffening bars, allowing the endpieces to be engaged in the stiffening bars. After the cylindrical part of the endpiece comes a frustoconical part 30 which itself leads to a flat part 31. The endpieces 28 are engaged in the stiffening bars at an angle such that the flat part 31 lies in the plane of each screen.

In this way the contact between each stiffening bar bears against the outside face of the tracks 24, 25 via the endpieces which provide a surface contact against the latter.

FIG. 4 shows in cross section the guide of a pair of stiffening bars connected by spacers.

At the ends of the two stiffening bars a spacer 33 joins the bars together.

Notice that there is a hole in the strip 13 forming the inside wall of the sheath 15 to allow the spacer 33 to connect with the stiffening bars 16.

As can be seen, the spacer 33 carries a roller 32 whose diameter is slightly smaller than the distance between the tracks 24 and 25.

It will also be observed that filler endpieces 34 are engaged in the ends of the stiffening bars 16 to prevent the formation of folds at the ends of the bars 16.

In operation, the door behaves in the following manner: when the curtain 10 is in the closed position, the inside faces of each screen 11*a*, 11*b* are flat against the tracks of the jambs as can be seen in FIG. 3 or FIG. 4 largely because of the guide components, namely endpiece 28 and roller 32. This is made possible by the fact that the stiffening bars 16 are contained inside each screen 11*a*, 11*b*. This flat, continuous contact between the lateral edges of each screen and the jambs seals the door with remarkable efficiency and gives the curtain good weather and especially wind resistance, owing to the large number of stiffening bars 16.

The bottom edge of the door is sealed by the flexible bar 22 forming a surface contact with the ground.

When the curtain 10 is in the raised position due to the straps 20 being wound around the shaft 21, folds form symmetrically on each side of the door's opening plane. It should be observed that these folds form symmetrically in each screen 11*a*, 11*b* because of the weight of the stiffening bars without spacers which are themselves situated inside each screen 11*a*, 11*b*. Hence, even if the door is exposed to a violent wind, the risk of a fold forming between the two screens 11*a*, 11*b* is practically eliminated.

The invention thus provides a door having the many advantages indicated. In particular, the door's lateral sealing is excellent. In addition, because of its screens which can be assembled in the factory, installing a door according the invention on site is considerably simpler than installing doors such as those known in the prior art which require the screens to be assembled on site.

The invention is not of course limited to the embodiment described above by way of example: on the contrary, it encompasses all embodiments thereof.

For example, the sheaths of each screen could be formed by a zone of overlap between the panels and by two parallel weld lines or by a strip welded directly to the outside face of a panel.

It is also possible to make the curtain from a single piece of flexible material and fold it to form two screens.

One possible way of installing the invention would be in an embodiment in which the ends of the stiffening bars are directly placed against the jambs or against flexible or rigid tracks formed in the jambs.

The invention claimed is:

1. A door comprising two jambs, a transverse box joining the top ends of the two jambs, and a curtain moveable between a closed position in which it closes an opening formed by the jambs and box and an open position in which it is folded up under the box, wherein the curtain comprises two parallel screens that define an air cushion and that are suspended from a top region of the jambs, the curtain further comprising at least one lifting strap connecting a bottom part of the curtain to a shaft mounted in the box, and at least one transverse stiffening means fitted to each of the screens, side edges of each screen lying in flat continuous contact with the jambs to form an airtight lateral association between each screen and the jambs, wherein said at least one transverse stiffening means includes at least two pairs of stiffening bars, each of said pairs of said stiffening bars being engaged in two mutually opposite sheaths, are connected by at least one spacer disposed between the stiffening bars, said spacer carrying a roller engageable between two tracks that are formed in each of the vertical jambs and a filler endpiece engaged on ends of each of the stiffening bars, and at least one pair of stiffening bars without spacers positioned between two stiffening bars with spacers, in such a way that, during a raising of the curtain alternate folds form symmetrically about a plane in which the door opens, each of the stiffening bars without the spacer having a guide endpiece that is oriented in a plane of the screen in which the bar is oriented, the guide endpiece providing a surface contact against the outside face of the tracks when the curtain in in the closed position, and moving away from the outside surface of the tracks when the curtain is raised in the open position, wherein each screen comprises at least two transverse panels of flexible material connected by a sheath, and wherein a spacer connects ends of the pair of stiffening bars and carries a roller engageable between two tracks that are formed in each of the vertical jambs.

2. The door as claimed in claim 1, wherein there is formed in each screen a sheath in which a stiffening means is engaged.

3. The door as claimed in claim 2, wherein the sheaths of each of the screens are opposite each other.

4. The door as claimed in claim 1, wherein the spacer has an opening for the lifting strap to pass through.

5. The door as claimed in claim 1, wherein the bottom part of the curtain formed by the connecting fold between the two screens contains a flexible component comprising a flexible sleeve enclosing a flexible material.

6. The door as claimed in claim 1, wherein the stiffening bars have flexibility to absorb an abnormal exiting impact, to come free or to come away from tracks without suffering permanent deformation.

7. The door as claimed in claim 1, wherein a flexible bar is held in the connecting fold of the two screens, and a lower pair of bars with spacers and a succeeding pair of bars without spacers are at distances such that, when the curtain is in the raised position, the flexible bar projects beyond folds formed by each folded screen.

8. The door as claimed in claim 1, wherein each screen has, at a same height, at least one transverse panel made of a transparent material.

9. The door as claimed in claim 7, wherein between two pairs of bars with spacers, each screen is provided with at least one shape memory folding means capable of forming an outward fold in the curtain when the curtain is in the folded position.

10. The door as claimed in claim 1, wherein the curtain is made from a single component of flexible material and then folded on itself to form two screens.

11. The door as claimed in claim 7, wherein ends of each stiffening bar of a pair of bars without spacers are fitted with a guide endpiece which has a flat part oriented in a plane of the screen in which the bar is located, the endpiece being contained within the screen.

12. The door as claimed in claim 1, wherein two filler endpieces are engaged on the end of each of the two stiffening bars, the two tracks being engageable between the two endpieces, and the airtight lateral association being formed via the engagement of the two tracks between the two endpieces.

13. The door as claimed in claim 1, wherein a cable is engaged in at least one sheath whose ends are guided relative to the vertical jambs.

* * * * *